US008205388B2

(12) United States Patent
Yates

(10) Patent No.: US 8,205,388 B2
(45) Date of Patent: Jun. 26, 2012

(54) GATE ASSEMBLY AND METHOD OF USE THEREOF

(76) Inventor: Adam Yates, Harrogate (GB)

( * ) Notice: Subject to any disclaimer, the term of this patent is extended or adjusted under 35 U.S.C. 154(b) by 529 days.

(21) Appl. No.: 12/181,360

(22) Filed: Jul. 29, 2008

(65) Prior Publication Data

US 2009/0064595 A1 Mar. 12, 2009

(30) Foreign Application Priority Data

Jul. 31, 2007 (GB) ..... 0714828

(51) Int. Cl.
*E05C 1/12* (2006.01)

(52) U.S. Cl. ..... 49/394; 49/465; 49/55; 49/57

(58) Field of Classification Search ..... 49/394, 49/50, 55, 56, 57, 463, 465; 292/194, 195, 292/197, 202, 207, 300
See application file for complete search history.

(56) References Cited

U.S. PATENT DOCUMENTS 1,270,288 A * 6/1918 Gruber ..... 292/170
5,052,461 A * 10/1991 Stern ..... 160/224
5,570,915 A * 11/1996 Asadurian ..... 292/242
6,112,461 A * 9/2000 Cheng ..... 49/55
6,179,352 B1 * 1/2001 Schneeberger ..... 292/347
6,308,462 B1 * 10/2001 Andersen ..... 49/57
6,425,609 B2 * 7/2002 Cheng ..... 292/5
6,499,254 B2 * 12/2002 Rossman et al. ..... 49/55
6,536,163 B1 * 3/2003 Monahan et al. ..... 49/465
7,178,792 B2 * 2/2007 Monahan et al. ..... 256/73
2006/0103142 A1 * 5/2006 Talpe ..... 292/164
2006/0175028 A1 * 8/2006 Askinasi ..... 160/225
2006/0185253 A1 * 8/2006 Marsden et al. ..... 49/465
2006/0207180 A1 * 9/2006 Cheng ..... 49/57
2007/0022666 A1 * 2/2007 Andersen et al. ..... 49/394
2008/0191497 A1 * 8/2008 Mayo et al. ..... 292/169

* cited by examiner

*Primary Examiner* — Katherine w Mitchell
*Assistant Examiner* — Justin Rephann
(74) *Attorney, Agent, or Firm* — Robert Z. Evora, Esq.

(57) ABSTRACT

A gate assembly is provided including barrier means locatable in an opening defined by one or more wall and/or frame surfaces in use and movable between open and closed positions with respect to the opening. Handle means are provided to allow movement of the barrier means between the open and closed positions. At least part of the handle means is slidably mounted on the barrier means to allow sliding movement of the handle means from a raised position to a lowered position in use to allow said barrier means to be moved from the closed position to the open position.

11 Claims, 9 Drawing Sheets

GATE ASSEMBLY AND METHOD OF USE THEREOF

Figure 1:
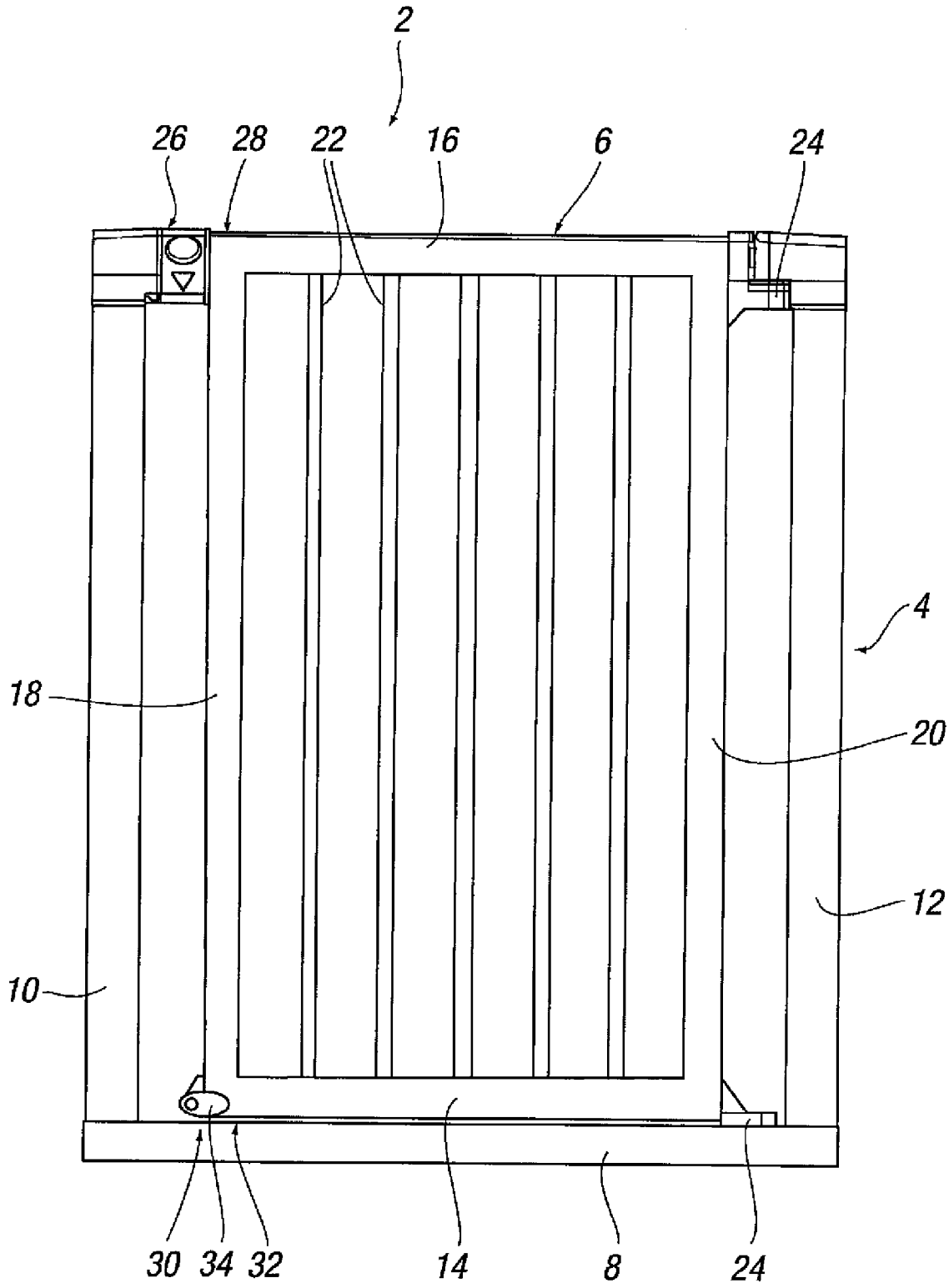

This invention relates to a gate assembly and method of use thereof.

It is known to provide a gate assembly for use in allowing selective access through an opening defined between one or more wall surfaces and/or frame members, thereby restricting access to one or more pre-defined locations on either side of the gate.

It is an aim of the present invention to provide an improved gate assembly.

It is a further aim of the present invention to provide a method of using an improved gate assembly.

According to a first aspect of the present invention there is provided a gate assembly, said gate assembly including barrier means locatable in an opening defined by one or more wall and/or frame surfaces in use and movable between open and closed positions with respect to said opening, and handle means to allow movement of said barrier means between said open and closed positions, and wherein at least part of said handle means is slidably mounted on the barrier means to allow sliding movement of the handle means from a raised position to a lowered position in use to allow said barrier means to be moved from the closed position to the open position.

The handle means are moved in a substantially vertical direction towards the base of the barrier means in moving the handle means between the raised and lowered positions.

Preferably latching means are provided on or associated with said handle means and are arranged such that slidable movement of at least a part of the handle means towards the base of the barrier means actuates said latching means (i.e. moves said latching means from a latched position to an unlatched position).

Preferably the handle means includes an inner housing and an outer housing and the outer housing is slidably mounted on the inner housing to allow the outer housing to be slidably movable relative to the inner housing in use.

Preferably the latching means is movable between a latched position, wherein the barrier means is maintained in the closed position, and an unlatched position, wherein the barrier means can be moved to an open position.

Preferably the latching means includes at least one latch member and said latch member engages either of a frame or wall surface or the barrier means in the latched position, and disengages the other of the frame or wall surface or barrier means in the unlatched position.

Preferably the at least one latch member is movably mounted on the handle means and movement of at least part of the handle means moves the latch member between the latched and unlatched positions.

In one embodiment the at least one latch member is pivotably mounted to said handle means, and preferably pivotably mounted to the inner housing of the handle means.

In a preferred embodiment the latch member has a first end which is pivotably mounted to the handle means or inner housing and a second end which is moved into and out of engagement with the frame or wall surface relative to which the barrier is movable.

Preferably resilient biasing means are provided on or associated with said latching means to bias the latch means to the latched position. As such, once a user releases the handle means and/or allows the barrier means to move to a closed position, the latching means automatically moves to a latched position on engagement of the latch member with said barrier means frame or surrounding wall. This prevents the gate assembly from being accidentally left unlatched after use.

In one embodiment resilient biasing means are provided on or associated with said handle means to bias the handle from the lowered position to the raised position when a user releases their grip thereon. The resilient biasing means can be the same biasing means as associated with the latching means or can be additional to or an alternative to said latch biasing means. The user has to apply sufficient force on said handle means to overcome the resilient bias of said biasing means in order to move the handle means from a raised position to a lowered position.

The handle means can be provided at any suitable location on the gate assembly. In a preferred embodiment the handle means are associated with or provided on a top or upper section of the gate or barrier means. This prevents access to the handle means by a small child. In addition, since the force required to slidably move the handle means to the open position is preferably required to be applied substantially vertically above the handle means, this further prevents a small child from being able to accidentally open the gate assembly.

The handle means and/or latch means can be provided on a frame or wall surface defining the opening in which the barrier means is located in use or the handle means can be provided on the barrier means.

Latch receiving means can be provided on or defined in a frame or wall surface defining the opening in which the barrier is located in use or can be provided on the barrier means. The latch receiving means can be in the form of a latch keeper housing, a recess, aperture, channel, slot and/or the like.

The barrier means preferably includes a top section, a base section, and optionally one or more side sections. Struts, material and/or other barrier material can be provided between the top and base sections to prevent access through said barrier means.

Preferably the handle means includes user actuation means which need to be actuated or moved by a user from an "out of use" position to an "actuated" position prior to or substantially simultaneously to the user sliding the handle means from the raised position to the lowered position.

In one embodiment the user actuation means can include one or more buttons which need to be depressed in order to actuate said user actuation means. The button is typically moved inwardly of said handle means to actuate the same.

In one embodiment a button is located on opposite sides of the handle means and said buttons are moved towards each other and preferably substantially simultaneously in order to actuate said user actuation means.

Preferably resilient biasing means are provided on or associated with said user actuation means for biasing the same to the "out of use" or outwardly position.

The resilient biasing means mentioned herein can include one or more springs, sprung material and/or the like.

In one embodiment the user actuation means can include slidable bolt means.

According to a second aspect of the present invention there is provided a method of using a gate assembly, gate assembly including barrier means locatable in an opening defined by one or more wall and/or frame surfaces in use and movable between open and closed positions with respect to said opening, and handle means to allow movement of said barrier means between said open and closed positions, and wherein said method includes the step of sliding at least part of said handle means relative to the barrier means from a raised position to a lowered position in use to allow said barrier means to be moved from the closed position to the open position.

Preferably the gate assembly is in the form of a child safety gate. The gate assembly can be used to prevent access by small children, animals and/or the like to pre-defined locations without adult supervision.

Since the handle means is moved substantially downwardly in the direction of gravity when opening the same in use, less force is required to open the gate, thereby making the gate easier to open. In addition, in one embodiment due to the user actuation means and/or the position of the handle means at a height above the height of a small child, and the simultaneous actuation requirement, accidental opening of the gate by a small child is prevented.

Figure 2A:
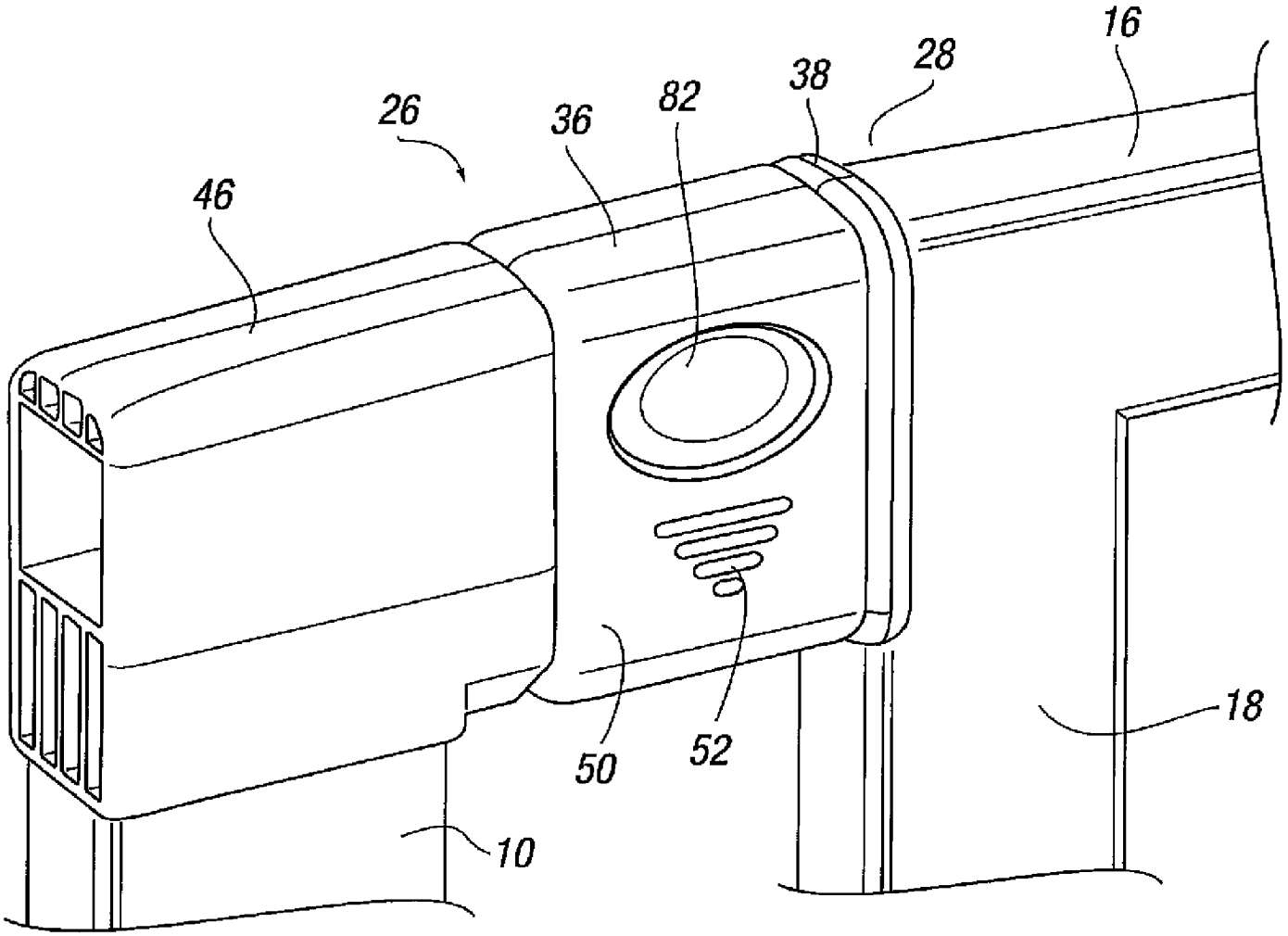
Figure 2B:
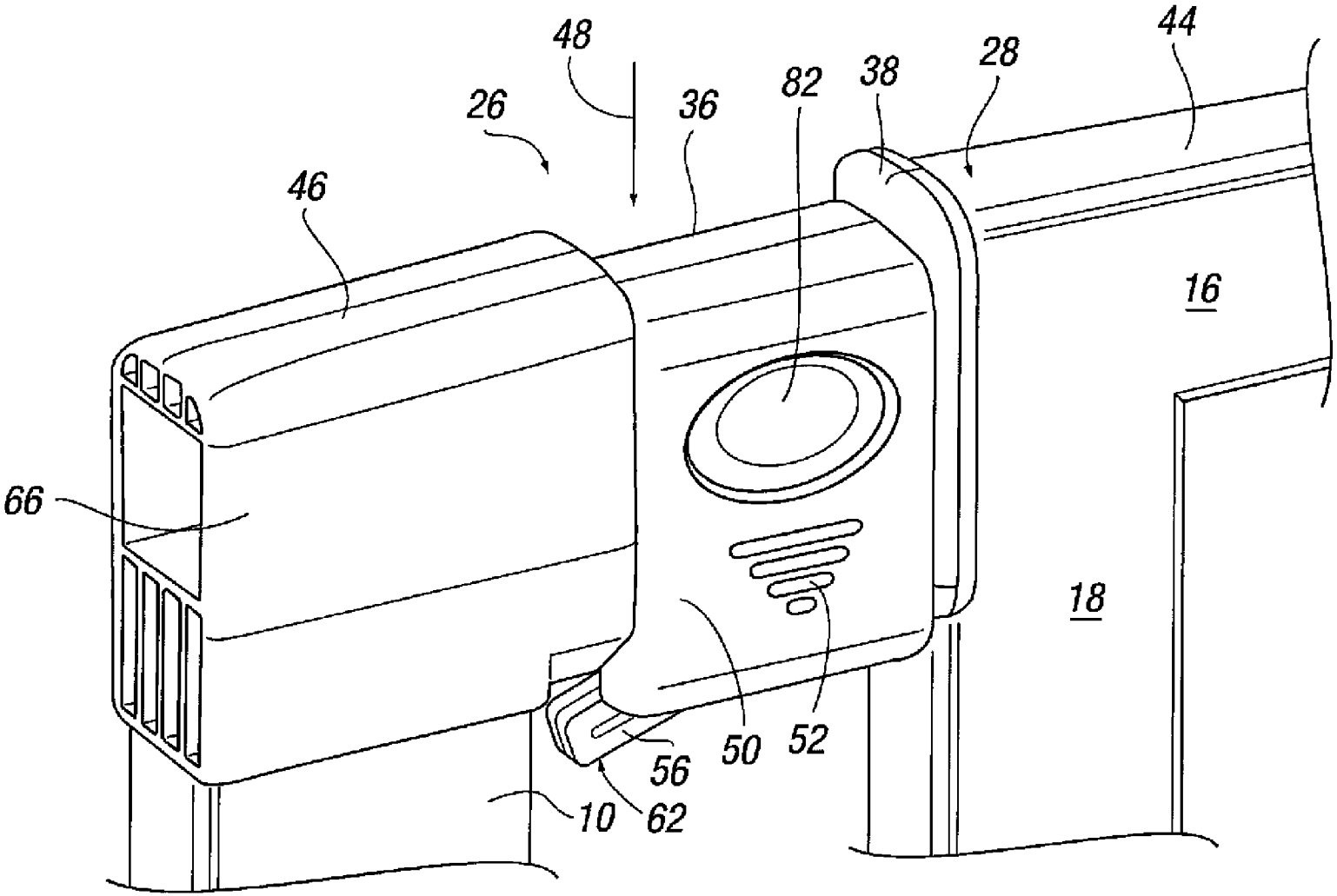
Figure 2C:
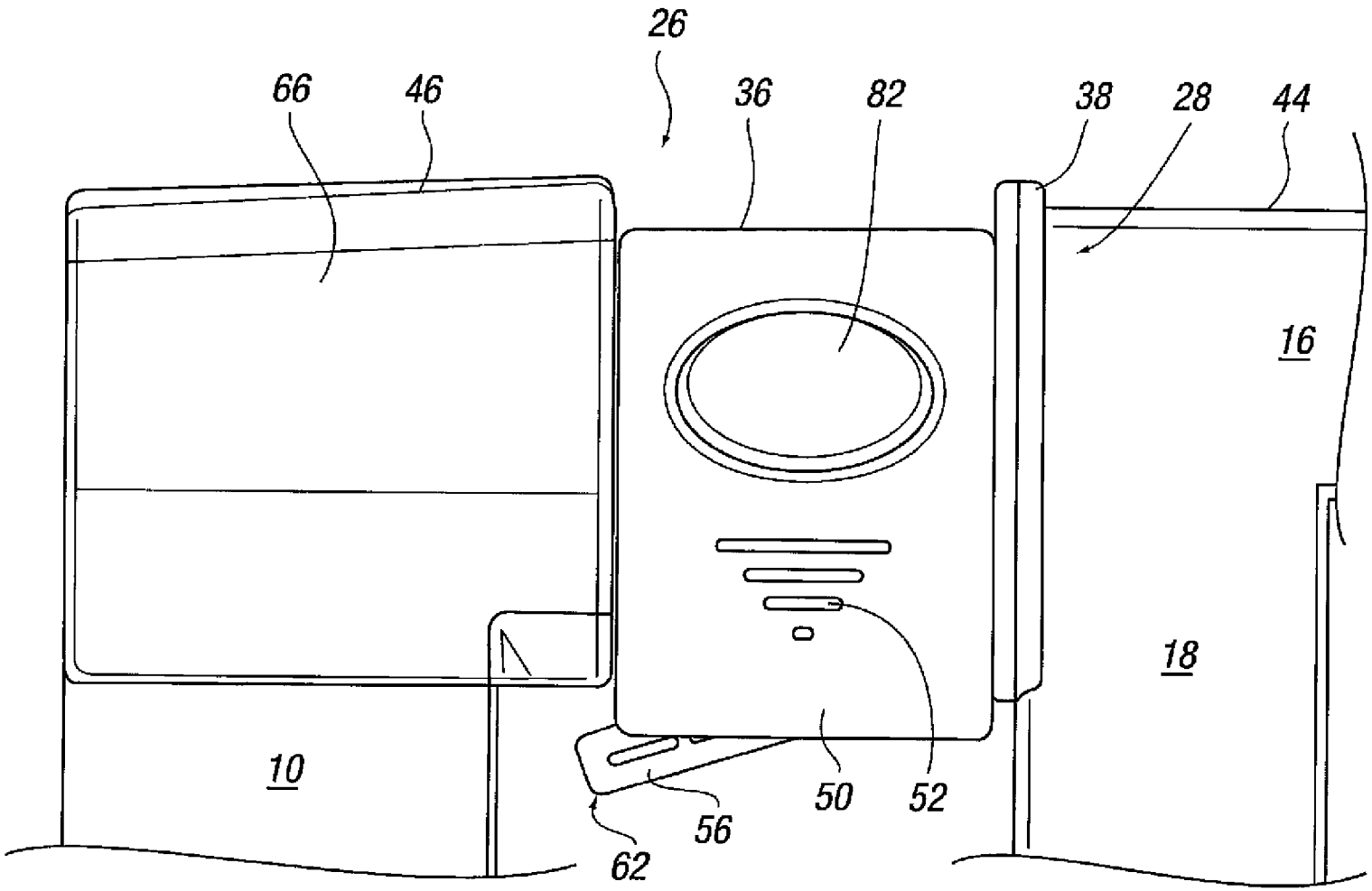
Figure 3A:
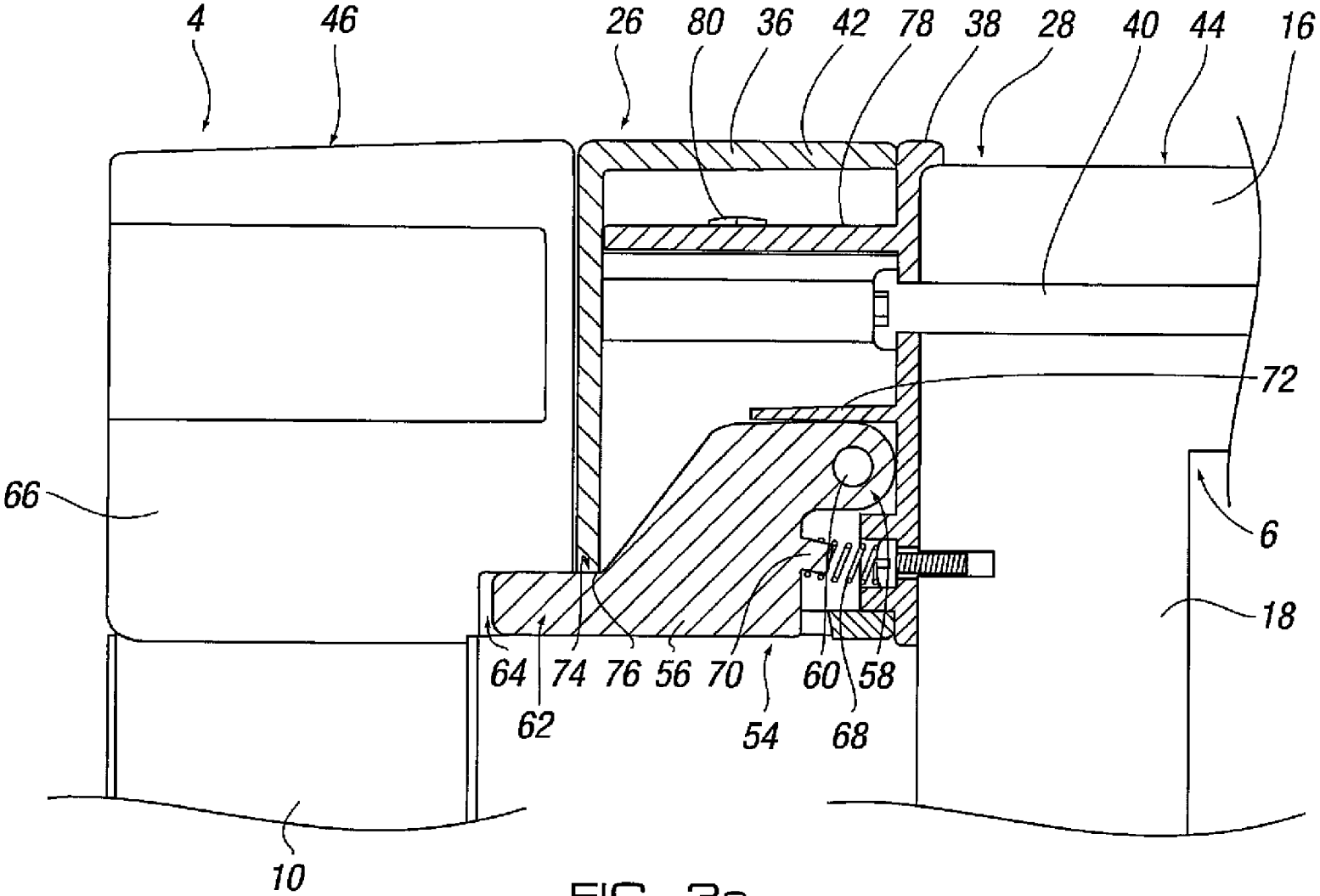
Figure 3B:
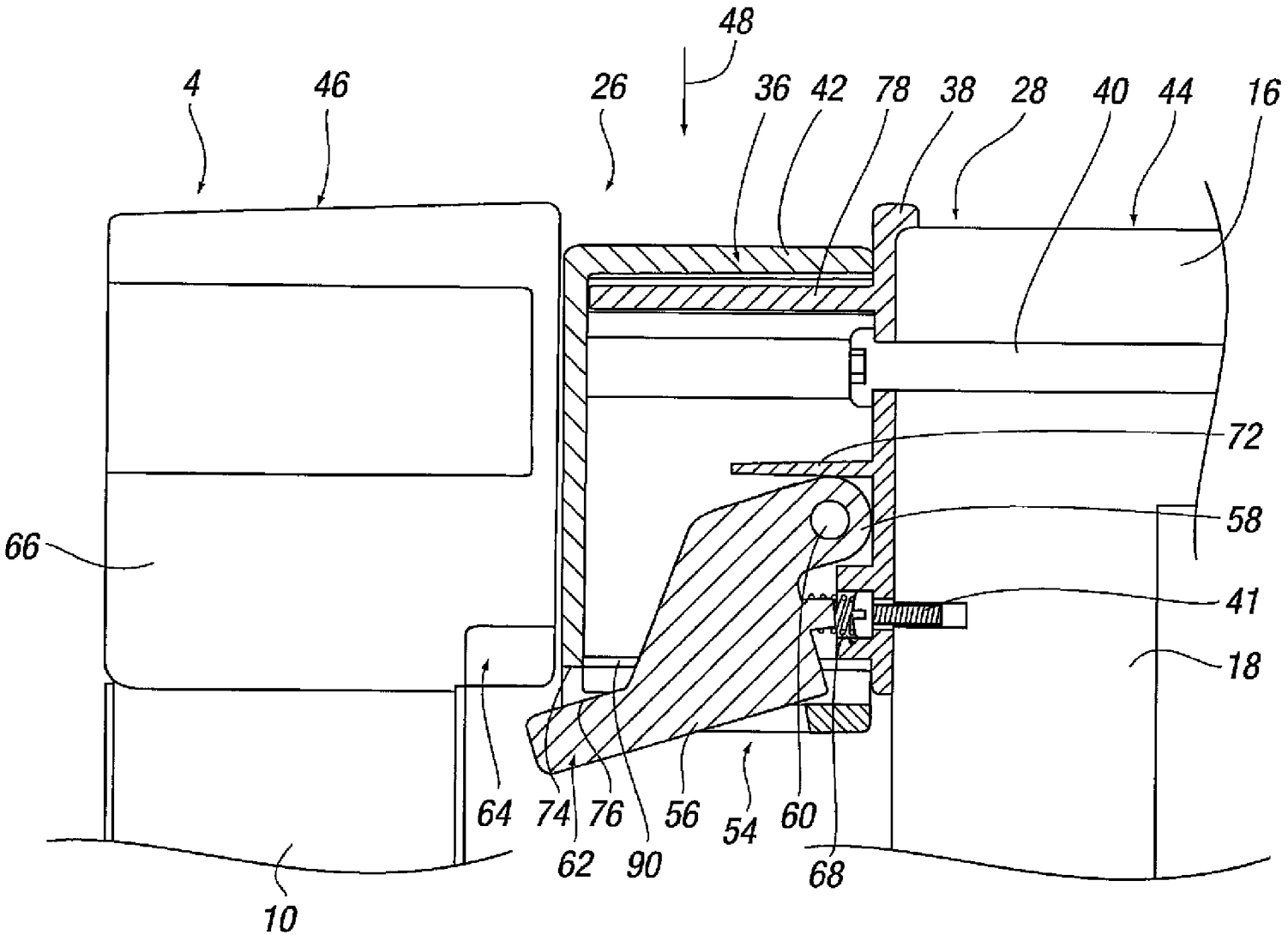
Figure 4A:
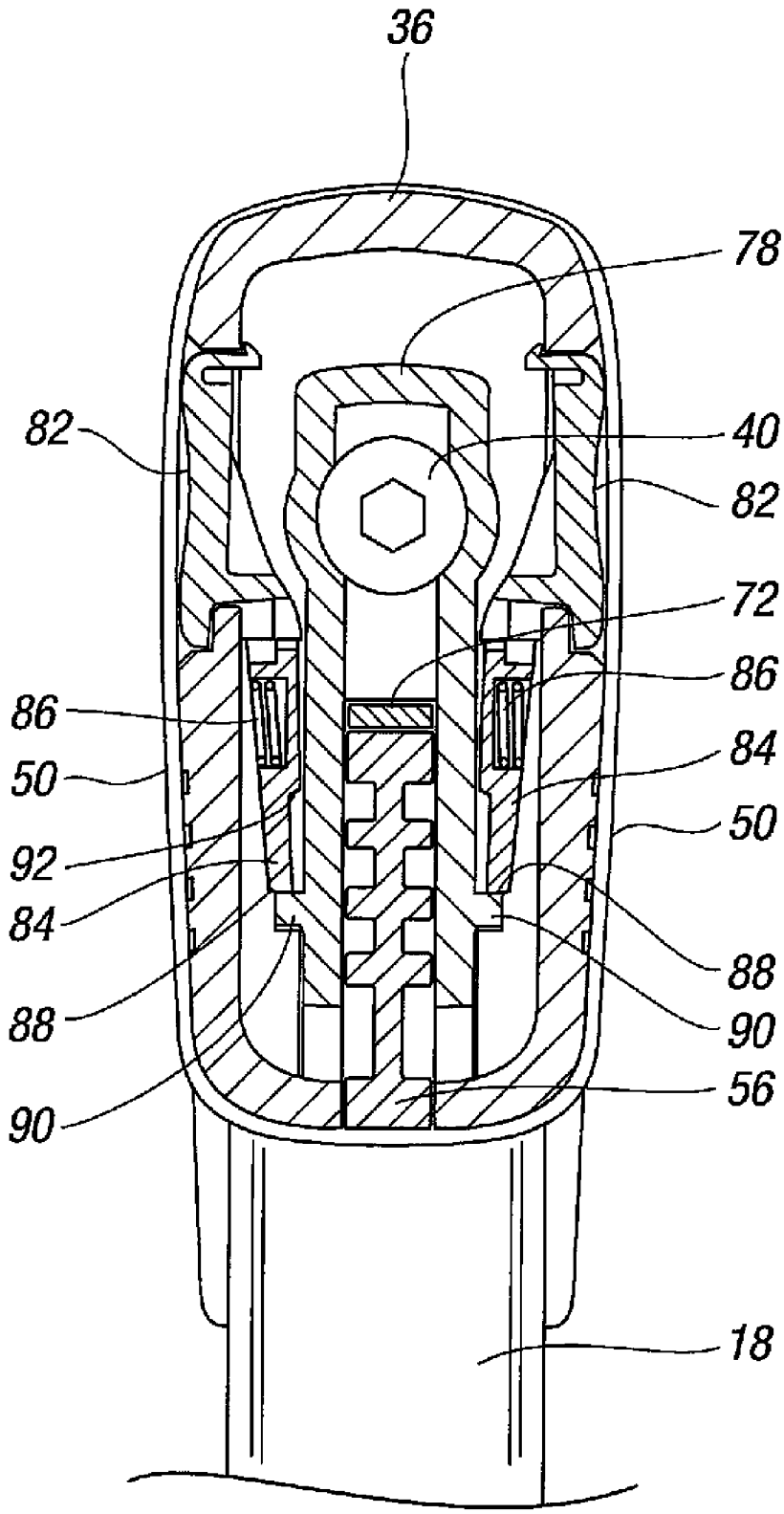
Figure 4B:
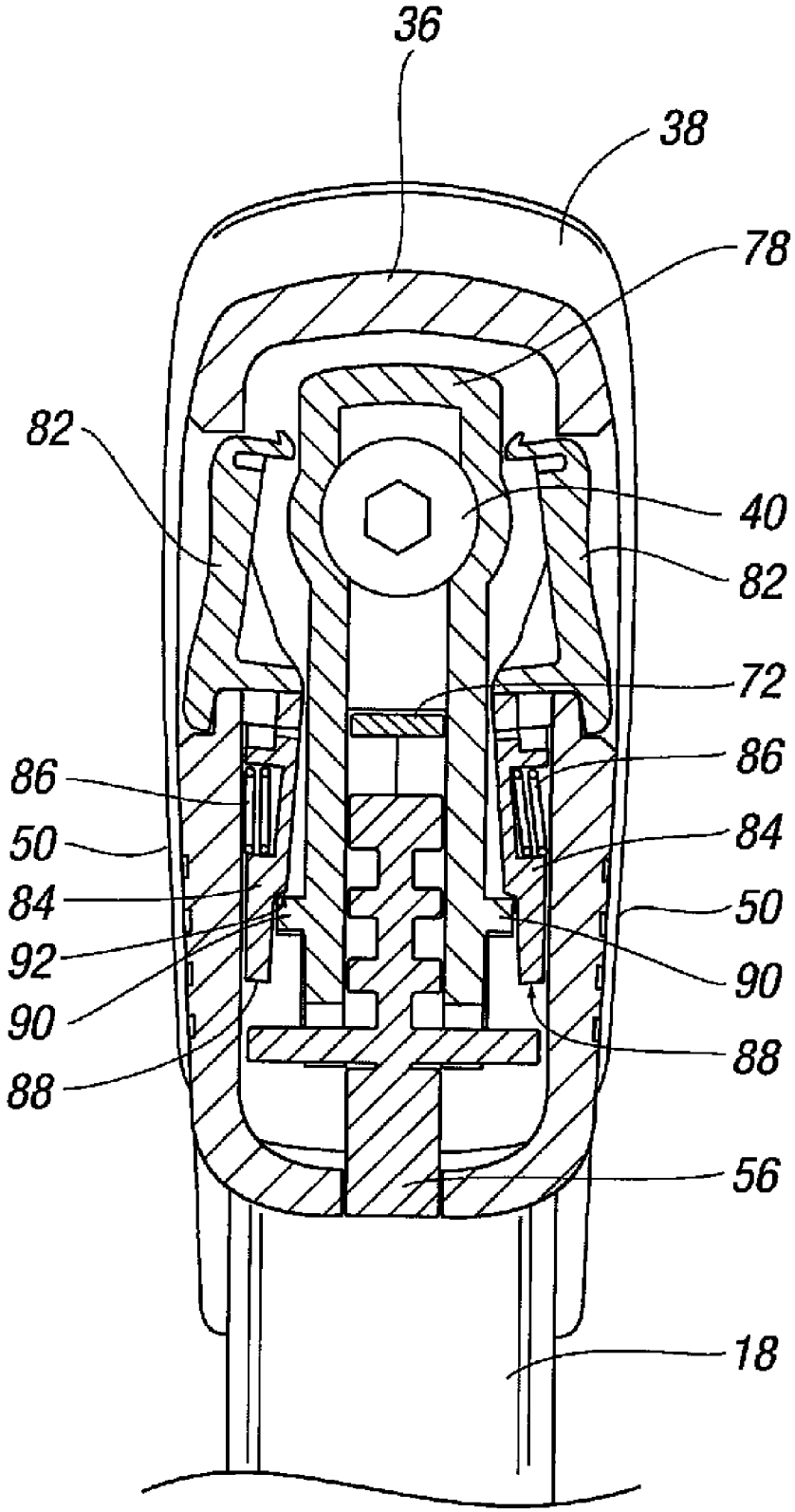
Figure 5:
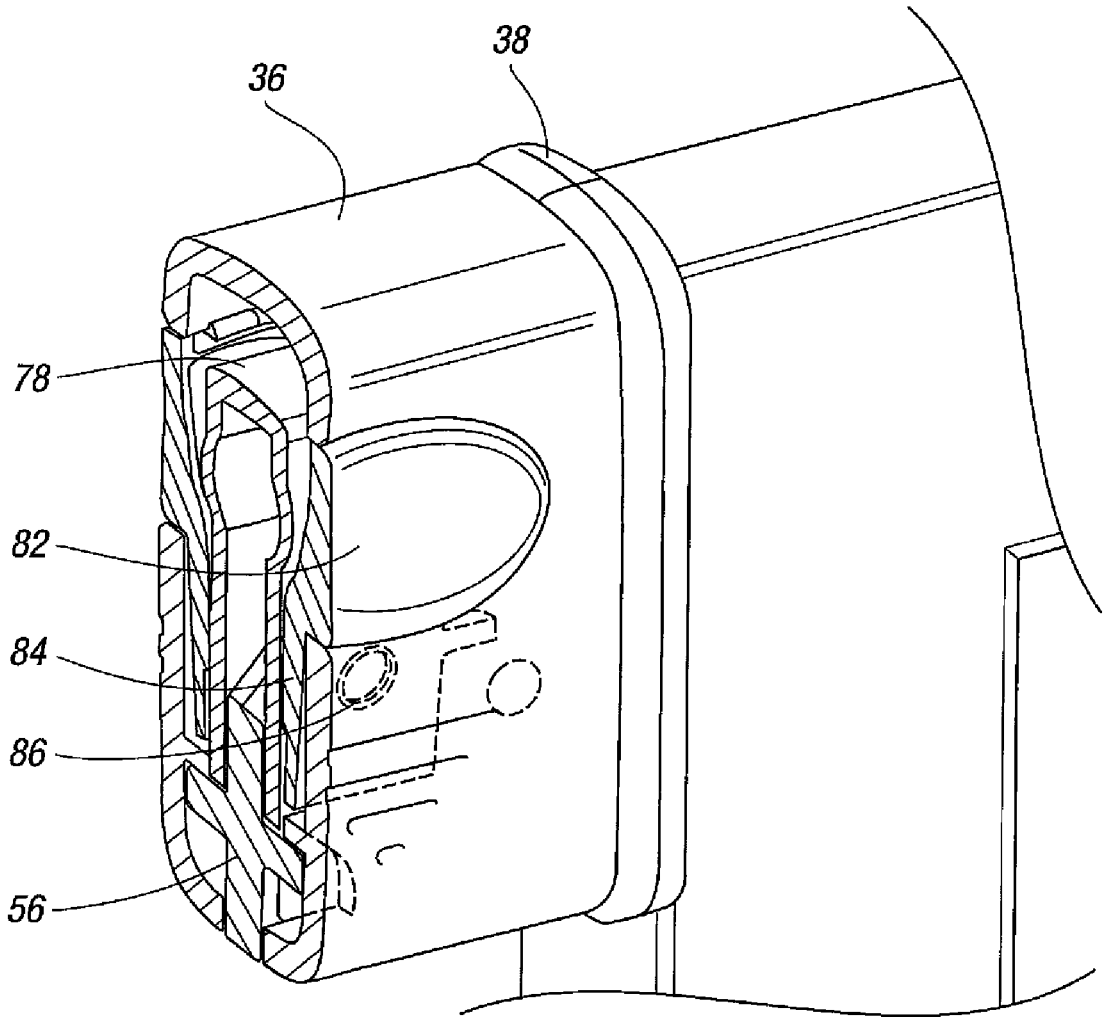

An embodiment of the gate assembly according to the present invention is illustrated by way of the following figures, wherein:

FIG. 1 is a front view of the gate assembly;

FIGS. 2*a*-2*c* show a detailed perspective view of the handle means in a closed position, a detailed perspective view of the handle means in an open position, and a front view of the handle means in an open position respectively;

FIGS. 3*a* and 3*b* show front cross sectional views of the handle means in a closed position and open position respectively;

FIGS. 4*a* and 4*b* show cross sectional views of the handle means with the user actuation buttons in an undepressed position and a depressed position respectively; and FIG. 5 shows a detailed cross sectional view of part of the user actuation means and latching means.

Referring to the figures, there is illustrated a gate assembly in the form of a child safety gate 2 which is movable between open and closed positions to allow selective access through the gate.

Gate 2 includes a frame 4 for location in an opening defined by one or more wall surfaces, and barrier means 6 in the form of a gate panel which is movable relative to frame 4 between the open and closed positions.

More particularly, frame 4 includes a base frame member 8 and two upright frame members 10, 12 located at either end of said base frame member 8. Barrier 6 includes a base barrier member 14, a top barrier member 16 and side barrier members 18, 20 located between the top and base barrier members 14, 16 at either end thereof. A plurality of struts or intermediate upright spaced apart barrier members 22 are located between the base and top barrier members 14, 16.

Side barrier member 20 is hingedly mounted to upright frame member 12 and/or base frame member 8 via hinges 24. Any suitable hinge arrangement can be used. The hinges allow the barrier 6 to be pivotably moved between the open and closed positions. The hinges typically allow rotation of the barrier means about a substantially vertical axis or an axis substantially parallel to side member 20.

Handle means 26 are mounted on the upper end 28 of side barrier member 18 and movement of the handle means 26 allows the barrier 6 to be moved between the open and closed positions, as will be described in more detail below. The handle means are provided on the opposite side of barrier 6 to the hinges 24.

Optional latching means 30 can be provided on lower end 32 of side barrier member 18 for latching the lower part of barrier 6 to base frame member 8. More particularly, latching means 30 includes latching arm 34 which is pivotably movable between an unlatched position, wherein latching arm 34 is a spaced distance apart from base frame member 8 (such as in a substantially horizontal position), as shown in FIG. 1, and a latched position, wherein latching arm 34 is pivotably moved into engagement against base frame member 8 (such as in a substantially vertical position). In a preferred example, a user simply pivots arm 34 between the latched and unlatched positions in use.

Referring to FIGS. 2*a*-3*b*, handle 26 includes an outer housing 36 which is slidably mounted on an inner housing 38. The inner housing 38 is mounted to upper end 28 of barrier 6 via a bolt 40 and screw 41 located through respective apertures and channels defined in said inner housing 38 and upper end 28 respectively. Outer housing 36 of the handle means is slidably movable relative to inner housing 38 from an upper position, as shown in FIG. 3*a*, to a lower position, as shown in FIG. 3*b*. In the upper position, the top wall 42 of outer housing 36 is substantially flush with the top edge 44 of top barrier member 16 and top edge 46 of upright frame member 10. In the lower position, outer housing 36 is moved towards base barrier member 14 and top wall 42 is moved below top edge 44 and 46.

Resilient biasing means can be associated with the outer housing 36, such that when a user releases their grip on the handle 26, outer housing 36 slidably moves from the lower position to the upper position via the biasing force of the resilient biasing means. Thus, outer housing 36 is capable of undergoing reciprocal movement relative to inner housing 38 between the raised and lowered positions.

A user typically moves outer housing 36 by applying a force on top wall 42 and/or the side walls 50 thereof in a direction substantially vertically downwardly towards base barrier member 14, as shown by arrow 48. Gripping means, which in this example are in the form of one or more shaped recesses 52, can be provided on outer housing 36 to allow a user to more easily grip housing 36 and/or to visually indicate to a user (i.e. by way of an arrow) the direction which they are required to move the outer housing 36 to actuate the handle 26.

Movement of the handle 26 from the upper position to the lower position actuates movement of a latching mechanism 54. Latching mechanism 54 is movable between a latched position, as shown in FIG. 3*a*, wherein the barrier 6 is latched to frame 4 and the barrier is maintained in a closed position, to an unlatched position, as shown in FIG. 3*b*, wherein the barrier 6 is unlatched from frame 4 and the barrier can be opened.

Latching mechanism 54 includes a latching arm 56 having a first end 58 which is pivotably mounted to inner housing 38 via pivot 60, and a second end 62 which is movable between the latched and unlatched positions. In the latched position, end 62 engages in a recess 64 defined in an upper part or housing 66 or upright frame member 10. In the unlatched position, end 62 is moved a spaced distance apart from and preferably below recess 64, thereby allowing handle 26 to be moved apart from frame 4.

Resilient biasing means in the form of a spring 68 is associated with a lower protruding arm 70 or latching arm 56 to bias arm 56 from the unlatched position to the latched position in use (i.e. to bias arm 56 in an upwardly direction). The spring typically acts on the same side of the latching arm as the pivot and preferably on a part of said side below said pivot. Limiting means in the form of a protruding arm 72 is provided on inner housing 38 above pivot 60 to limit upward movement of arm 56 as it is returned to the latched position from the unlatched position by spring 68.

In use, as the outer housing 36 is moved in a downwardly direction by a user applying a downward force thereto, a lower end 74 of housing 36 engages with a top wall 76 of latching arm 56 adjacent second end 62, thereby causing arm 56 to pivot from the latched position to the unlatched position.

The degree of downward movement of outer housing 36 relative to inner housing 38 is limited via stop means in the form of a protruding arm 78 provide on inner housing 38. This ensures the latching arm 56 is moved through a pre-determined distance in use. The inner wall of top 42 of the outer housing engages with the upper surface of protruding arm 78 in the lower position. Cushioning means in the form of a resilient member 80 can be provided on the upper surface of protruding arm 78 or inner wall of top 42 to cushion the movement. Resilient member 80 could be in the form of resilient biasing means to bias the outer housing 36 from the lower position to the upper position if required.

Protruding arms 78 and 72 are preferably substantially parallel to each other, the longitudinal axis of the same being substantially parallel to the longitudinal axis of the top barrier member.

User actuation means in the form of two depressable buttons 82 are provided on opposite side walls 50 of outer housing 36. Buttons 82 are required to be depressed inwardly of housing 36 by a user just prior to and/or substantially simultaneously to sliding outer housing 36 relative to inner housing 38 between the upper and lower positions. Buttons 82 are joined to lower arms 84 which are pivotably mounted to outer housing 36 via resilient biasing means in the form of spring 86. Spring 86 fits into a recess or aperture defined in lower arms 84. The spring 86 biases the opposing lower arms 84 towards each other, thereby moving upper buttons 82 outwardly of each other.

With the lower arms 84 biased towards each other when the buttons 82 are not depressed, the lower edges 88 thereof engage with a protruding lip 90 defined on inner housing 38, thereby preventing downward movement of the outer housing 36 relative to inner housing 38, as shown in FIG. 4*a*. With buttons 82 depressed inwardly of housing 36 by a user, this causes lower arms 84 to move against the bias of spring 86 in an outwardly direction, thereby moving lower edges 88 a spaced distance apart from protruding lip 90 and allowing outer housing 36 to move downwardly relative to inner housing 38, as shown in FIG. 4*b*.

Stop means in the form of a shoulder portion 92 is defined on the inner surfaces of lower arms 84 which engages with lip 90 when the outer housing 36 is in the lower position, thereby limiting further movement of the outer housing relative to the inner housing.

The gate assembly can be formed from any or any combination of material, such as wood, plastic, metal, rubber, fabric and/or the like.

The invention claimed is:

1. A gate assembly including:

barrier means locatable in an opening defined by one or more frame surfaces in use and movable between open and closed positions with respect to the opening; and handle means to allow movement of said barrier means between said open and closed positions, said handle means comprising:

an inner housing mounted to the barrier means;

an outer housing slidably mounted on the inner housing, the outer housing slidably movable vertically from a raised position to a lowered position relative to the inner housing in use; and at least one latch member having a first end pivotably mounted to the inner housing and a second end movable between a latched position and an unlatched position with respect to one of the frame surfaces, and wherein downward movement of the outer housing moves a lower end of the outer housing into engagement with a top wall of the latch member adjacent the second end, thereby causing the second end of the latch member to move in a downwardly direction from the latched position, where the barrier means is in the closed position, to the unlatched position, where the barrier means can be moved to the open position.

2. A gate assembly according to claim 1 wherein resilient biasing means are provided with, or associated with, said handle means for biasing the handle means to the raised position in use.

3. A gate assembly according to claim 1 wherein resilient biasing means are provided on or associated with said latching means to bias the latching means to the latched position.

4. A gate assembly according to claim 1 wherein the handle means includes actuation means and said actuation means are required to be moved from an "out of use" position to an "actuated" position prior to, or substantially simultaneously to, the handle means being slid from the raised position to the lowered position.

5. A gate assembly according to claim 4 wherein the actuation means includes one or more buttons which are required to be depressed in order to move the buttons from the out of use position to the actuated position.

6. A gate assembly according to claim 5 wherein a button is located on opposing sides of the handle means and said buttons are depressed inwardly towards each other in order to move the buttons to the actuated position.

7. The gate assembly according to claim 6 wherein said buttons on opposite sides of the handle means are depressed inwardly towards each other substantially simultaneously to allow the handle means to slide from a raised position to a lowered position.

8. A gate assembly according to claim 4 wherein resilient biasing means are provided on, or associated with, said actuation means for biasing the actuation means to the out of use position.

9. A gate assembly according to claim 1 in the form of a child safety gate.

10. A gate assembly according to claim 1 wherein the at least one latch member is provided on or associated with an upper part of the barrier means and further latching means are provided on a lower part of the barrier means.

11. A method of unlatching the gate assembly of claim 1, the gate assembly comprising:

barrier means locatable in an opening defined by one or more frame surfaces and movable between an open position and a closed position with respect to the opening; and handle means to allow movement of the barrier means between the open and closed positions, the handle means comprising:

an inner housing mounted to the barrier means;

an outer housing slidably mounted on the inner housing; and at least one latch member having a first end pivotably mounted to the inner housing and a second end movable between a latched position and an unlatched position with respect to one of the frame surfaces, the method comprising:

vertically sliding the outer housing from a raised position in the latched position to a lowered position relative to the inner housing; and engaging the latch member with the outer housing adjacent to the second end and causing the second end to move downwardly into the unlatched position.

* * * * *